US005459963A

United States Patent [19]

Alexander

[11] Patent Number: 5,459,963

[45] Date of Patent: Oct. 24, 1995

[54] SAFETY GATE FOR LOADING DOCKS

[75] Inventor: James C. Alexander, London, Canada

[73] Assignee: The Serco Corporation, London, Canada

[21] Appl. No.: 167,207

[22] Filed: Dec. 16, 1993

[51] Int. Cl.[6] ..... E01F 13/00

[52] U.S. Cl. ..... 49/34; 49/49; 49/340

[58] Field of Search ..... 49/49, 35, 339, 49/340, 192, 34

[56] References Cited

U.S. PATENT DOCUMENTS

| | | | |
|---|---|---|---|
| 79,025 | 6/1868 | Taylor . | |
| 356,325 | 1/1887 | Mills . | |
| 690,006 | 12/1901 | Anthony et al. . | |
| 1,416,162 | 5/1922 | Black . | |
| 1,600,745 | 9/1926 | Tickner . | |
| 2,874,493 | 2/1959 | Mandel | 49/34 |
| 3,150,454 | 9/1964 | Staples . | |
| 3,877,174 | 4/1975 | McDonald . | |
| 4,010,571 | 3/1977 | McGuire et al. . | |
| 4,035,955 | 7/1977 | Burnett . | |
| 4,122,629 | 10/1978 | Rennick . | |
| 4,356,668 | 11/1982 | Wagner . | |
| 4,519,164 | 5/1985 | Porter | 49/340 X |
| 4,531,325 | 7/1985 | Phillips | 49/49 |
| 4,779,379 | 10/1988 | Steen | 49/339 X |
| 4,879,554 | 11/1989 | Diaz-Silveira . | |
| 4,897,960 | 2/1990 | Barvinek et al. | 49/49 |
| 4,920,598 | 5/1990 | Hahn . | |
| 4,989,835 | 2/1991 | Hirsh | 49/34 X |
| 5,040,258 | 8/1991 | Hahn et al. . | |
| 5,136,810 | 8/1992 | De Witt, III | 49/49 |
| 5,299,386 | 4/1994 | Naegelli et al. | 49/340 X |

*Primary Examiner*—Philip C. Kannan

*Attorney, Agent, or Firm*—Sughrue, Mion, Zinn, Macpeak & Seas

[57] ABSTRACT

A barrier for a loading dock having an opening in a wall having a dock leveler positioned in a floor of the loading dock adjacent said opening. The dock leveler has a horizontal position where traffic may cross to adjacent areas of the loading dock. A support is located along a side of the dock leveler. A deformable barrier arm is pivotedly connected to the support by a mounting for movement between a horizontal blocking position and a raised vertical position exposing the opening. The mounting has a pivotal connection to the support to permit the deformable barrier arm to move in a vertical arc for raising and lowering the arm and a loose connection to the barrier arm to permit relative motion between the barrier arm and the mounting upon the application of a horizontal load to the barrier arm.

24 Claims, 5 Drawing Sheets

SAFETY GATE FOR LOADING DOCKS

BACKGROUND OF THE INVENTION

This invention relates to loading dock technology. In particular, it relates to a safety gate which is placed at loading dock openings to prevent vehicular or foot traffic from falling off the end of the dock and to prevent injury.

Doors of a loading dock are often left in the opened position either for purposes of ventilation or because of the frequency of use of the dock makes closing the door inconvenient. Such loading docks are generally equipped with dock levelers, many of the pit type which when stored in a cross-traffic position allow forklift trucks and workers to traverse laterally across the pit area. When no trailer is parked at the door, there is a possibility that a forklift truck while maneuvering between other doors or aisles can accidentally be backed or driven through an open doorway or fall off the dock into the driveway below. Similarly, a pedestrian walking near a doorway could accidentally step over the edge.

Within loading dock and material handling technology, a number of devices are presently in use which partially address this problem. However, they have several significant deficiencies. One group of technology extends the lip of the dock leveler above dock level in the stored or cross traffic position. The purpose is to erect a barrier at floor level which will prevent a forklift truck from backing or otherwise driving over the edge. Typical of these devices are those found in U.S. Pat. Nos. 4,920,598 and 5,040,258. The devices disclosed therein are derivatives of the so-called "Post Office Lip". In general, the concept is to have a lip which extends above the dock floor when the dock leveler is in the stored, cross traffic position. However, when the dock leveler is actuated and the lip extended, the barrier retracts to thus allow traffic to move in an unimpeded manner over the leveler.

While these devices may serve to prevent a vehicle from rolling off the dock, in actuality it compromises overall dock safety because a pedestrian has to deal with a newly created tripping hazard. That is, these lip extensions are generally fairly low and even if visibly marked extend to a height above the dock which causes a stumbling point for a pedestrian. Moreover, such devices are also pinched-points should the dock leveler require manual intervention in order to actuate and fully raise the lip. Finally, such devices prevent an end-loading operation below dock level.

Moreover, such devices define a rigid barrier with little to no deflection to provide energy absorption. For example, if a forklift truck traveling at 5 miles per hour strikes a barrier which deflects minimally, for example, 0.5 inches the deceleration will be in the order of 18G. A forklift truck typically weighs about 10 thousand pounds and the force of impact would be over 180 thousand pounds exerted against the lip of a dock leveler. Even if this force would not damage the dock leveler itself, the forklift truck or the cargo would be subjected to high deceleration, and could result in serious injury to the forklift truck driver.

SUMMARY OF THE INVENTION

Given the deficiencies in prior art devices, it is a fundamental object of this invention to provide a barrier which not only prevents a vehicle from rolling off the dock but also provides energy absorption to stop the forklift truck with a controlled force and a significantly reduce deceleration.

Yet another object of this device is to provide a barrier which is effective for both pedestrian and vehicular traffic while not creating additional hazards.

Yet another object of this invention is to provide a barrier used at a loading dock in conjunction with dock levelers, which is effective to provide a warning barrier yet, not interfere with dock loading operations at any stage whether the leveler is in the stored cross-traffic position or is in use with a truck at the loading dock station.

These and other objects of this invention are achieved by the use of a pivoting beam which is placed across the door opening. The beam is designed to withstand a predetermined load without deformation yet yield by bending if higher forces are imposed. For example, in accordance with this invention the beam is designed to yield at a force of 8 thousand pounds if applied at the mid point such that a 10 thousand pound vehicle striking the barrier at 5 miles per hour will have a deceleration reduced to only 0.8 g with significant beam deflection.

Moreover, in accordance with this invention the forces of deflection are resisted entirely by the barrier posts so that no impact force is transferred to the dock leveler. Additionally, given the positioning of the barrier, the invention is operative even in loading dock openings where no dock leveler is installed. These and other objects of this invention will be explained in greater detail by reference to the attached figures and the description of the preferred embodiment which follows.

BRIEF DESCRIPTION OF THE DRAWING

FIGS. 5 and 6 respectively are side views of a third preferred embodiment of this invention wherein, FIG. 5 illustrates the barrier gate in a down position and FIG. 6 illustrates the gate in a vertical stored position.

DESCRIPTION OF THE PREFERRED EMBODIMENTS

Figure 1:
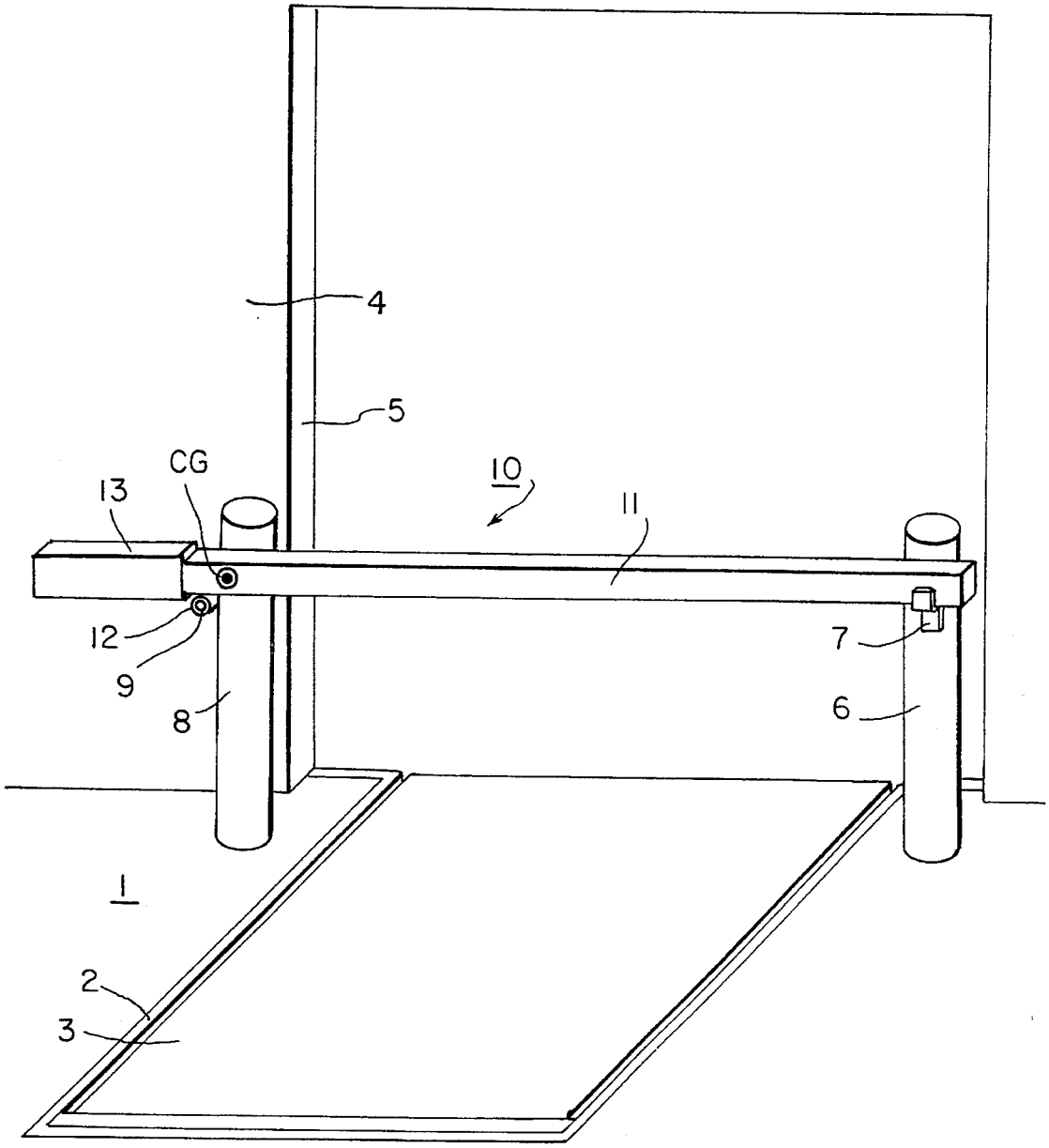
FIG. 1 is a perspective schematic view of a loading dock door in which a first preferred embodiment of this invention is depicted.
Figure 2:
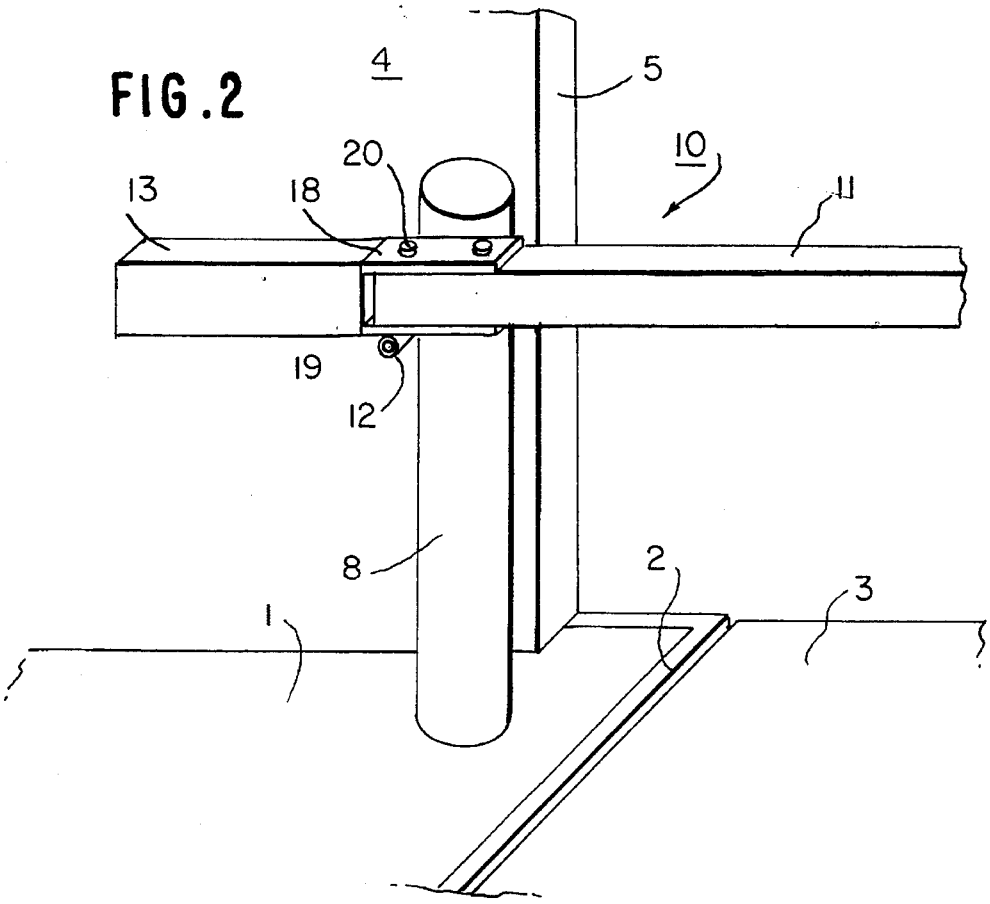
FIG. 2 is a schematic enlarged partial view of the embodiment of FIG. 1 showing details of attachment for the safety gate.
Figure 3:
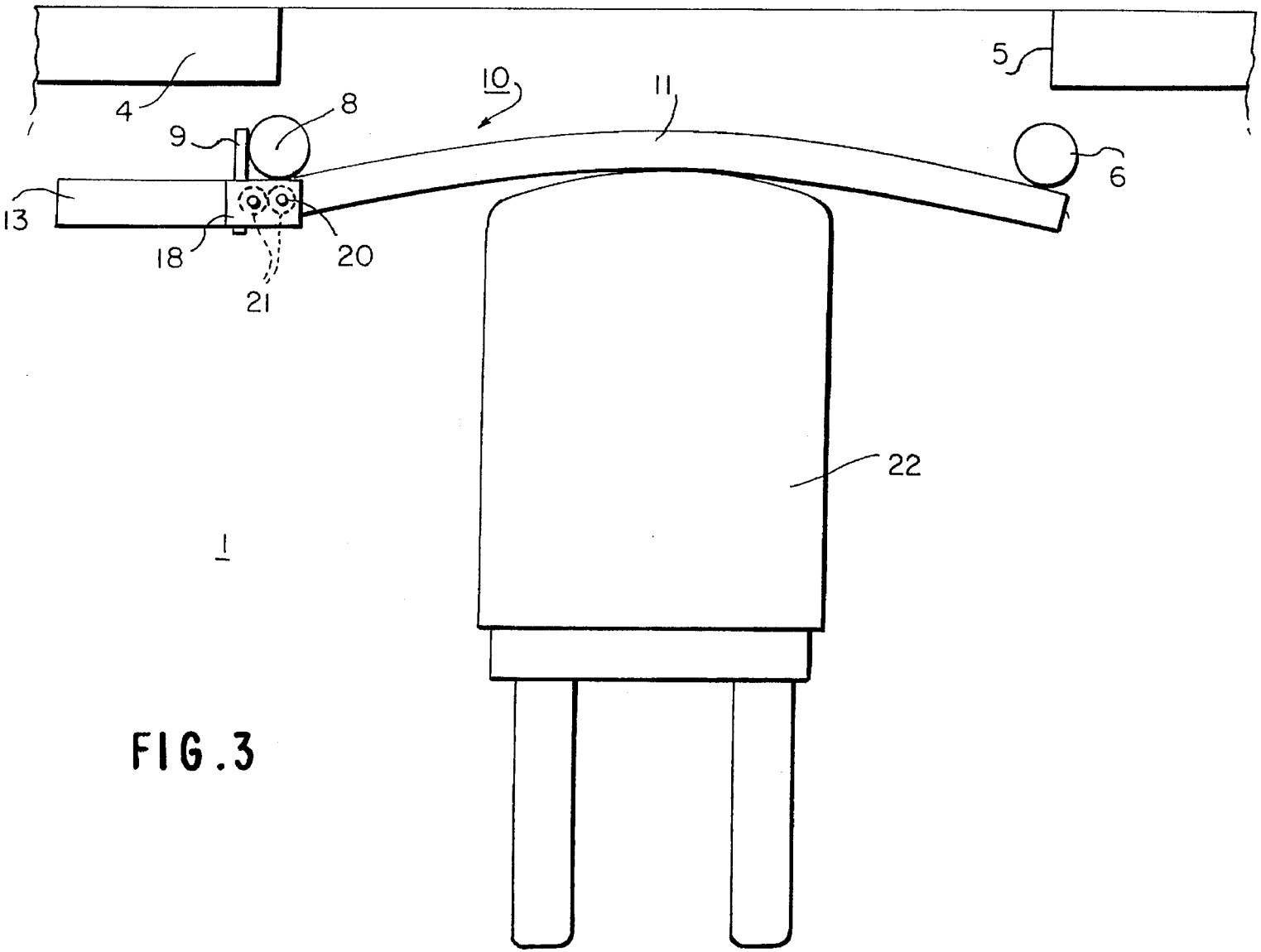
FIG. 3 is a top view of the first embodiment of this invention depicted in FIG. 1 illustrating deflection of the beam upon impact.

Referring now to FIGS. 1, 2 and 3, a first preferred embodiment of this invention is depicted. In those figures, numeral 1 represents a dock floor having a recessed pit 2. Conventionally, installed in the pit 2 is a dock leveler 3. The dock leveler is shown in the stored cross-traffic position. It will be understood that at the door opening 5 which is cut into a wall 4, a dock leveler lip hangs pendant from the dock leveler 3.

In accordance with a first preferred embodiment of this invention, the safety gate comprises 2 structural posts 6 and 8. Those structural posts may be steel pipe filled with concrete or some other structure as required. For example, while not shown the structural posts 6 and 8 can comprise angle brackets of steel. They are anchored by suitable means, not shown, into the concrete floor 1. A bracket 7 is attached to the front of post 6. A pivot pin 9 is attached to the side of post 8.

The barrier assembly 10 comprises a beam 11 attached to a pivot housing 12 which is carried by the pivot pin 9. A counterweight 13 is attached to the end of the beam 11 and is placed on the side of the pivot 9 to provide the necessary counter force so that the barrier 10 can be easily raised or lowered. In that regard, as illustrated in FIG. 1, the center of gravity CG of the barrier assembly 10 is located above and to the right of the pivot 9. The center of gravity is thus selected as a function of the size and location of the counter weight 13 to cause this offset of the center of gravity of the barrier assembly with respect to that of the pivot point 9. By so offsetting, the weight of the barrier will cause it to remain in the horizontal position with the end supported by the bracket 7. When the barrier is rotated to the vertical position the location of the center of gravity, CG will be moved to the left of the pivot and thus causes the barrier to remain raised.

The barrier 10 when in a vertical position occupies very little space and thus will not obstruct traffic through the doorway. Moreover, by appropriately locating the support posts 6 and 8 protection for the edges of the door opening occurs. This derivative benefit of the invention is one which provides protection for items such as tracks of an overhead door and corners of the openings which would otherwise be subject to impact damage from a forklift truck. It will be appreciated however that depending on the installation, the second support 6 can be eliminated. The gate 11 can limited in its downward rotation by a stop on post 8, not shown. Deflection of the gate 11, as illustrated in FIG. 3 would result in the gate bearing against the wall 4.

Referring now to FIGS. 2 and 3 additional details of this invention are depicted. In particular, as illustrated in those figures the attachment of the beam 11 to the pivot point 12 is illustrated. It will be appreciated that the barrier 11 itself can withstand significant force such that a severe impact would cause the beam 11 to be severely deformed. The beam 11 is constructed of appropriate materials such as steel or high strength plastic composites to permit a degree of elastic deflection.

However, in accordance with this invention deformation of the beam 11 is accommodated in the design and the yielding by bending does not result in bending force to the pivot pin 9. Thus, while the beam 11 may be subjected to high impact forces, the combination of materials and mounting prevents damage.

FIG. 2 illustrates the construction where the counterweight 13 is attached to two plates 18 and 19. The pivoting housing 12 is attached to the bottom plate 19. The beam 11 is clamped between the two plates by means of bolts 20. The holes in the beam are much larger than the bolts (see FIG. 3) so the beam has significant motion relative to the plates 18 and 19. This construction allows the beam 11 to be deformed, as illustrated in FIG. 3 without damaging the pivoting structure. It also facilitates removal and replacement of the beam if it is severely damaged. The enlarged holes in the beam 11 are shown by the dotted lines 21 in FIG. 3.

Consequently, as illustrated in FIG. 3 the beam 11 may deflect upon impact by a forklift truck shown schematically as element 22. Such impact will cause a deflection of the beam 11 and thus a shifting in the bolts relative to the elongated oversize holes 21 in the beam 11. As can be appreciated then, the beam 11 is clamped by means of the plates 18 and 19 to allow it to be raised but, the beam 11 can shift in the horizontal plane as a consequence of the oversize holes 21 which allow the beam 11 to move relative to the bolts 20. The result is deflection of the beam without damage to the pivot structure because the force is totally resisted then by the barrier posts. This is shown in FIG. 3 by the contact of the beam 11 against the posts 6 and 8.

Figure 4:
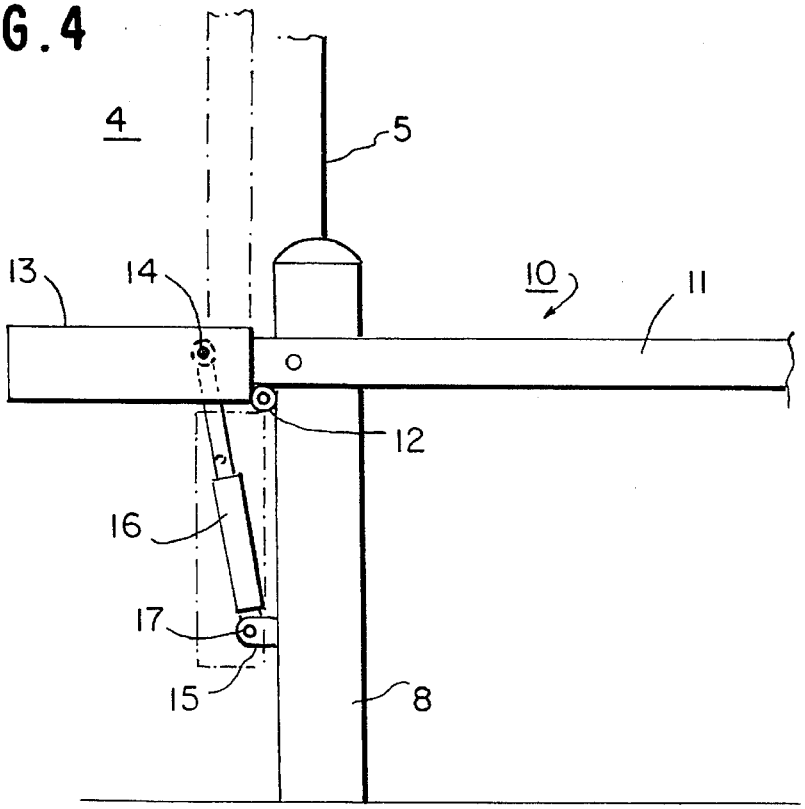
FIG. 4 is a schematic partial perspective view of a second embodiment of this invention having a different mode of actuation.

While the barrier may be easily moved by hand given the counterweight structure, FIG. 4 illustrates a second modification. Those items which are identical to the embodiment of FIG. 1 are retained with the same identifying numerals. FIG. 4 adds a mechanical mechanism of actuation whether it be a hydraulic cylinder or electric actuator. The dotted lines illustrate the position of the barrier in the raised position.

A pin 14 is attached to the back of the weight 13 and a bracket 15 is attached to the post 8. The hydraulic cylinder or electric actuator 16 has one end mounted on the pin 14 and the other end attached to the bracket 15 via a pin 17. The actuator extends to lower the barrier and retracts to raise it.

The unit can thus be raised or lowered by means of push buttons or a selector switch on a control panel not shown, at a remote location. Moreover, limit switches, not shown, may be mounted on the post 8 to detect the position of the barrier and automatically switch off power when the barrier is in the desired position.

An additional advantage of having powered actuation of the barrier 10 is that it may be automatically actuated by another device.

For example, many docks have vehicle restraints such as those described in U.S. Pat. No. 4,988,254 to prevent a trailer from moving away from a dock. The electrical controls of the vehicle restraint and the barrier may be interconnected so that the barrier is automatically raised when the vehicle restraint has been engaged. Similarly, the barrier may be automatically lowered when the vehicle restraint is disengaged. This would thus allow loading and unloading operations when the dock has been secured, that is, when a truck has backed in, has been secured and the loading operation is ready to commence. It would also provide a safety switch by which the gate could not be raised unless a truck was in position.

Such automatic actuation would not depend on human intervention but would prevent the barrier from being raised unless a trailer is secured at the dock. Also, operation of the gate could be keyed to actuation of other equipment such as a door or a dock leveler. Thus, unless the door has been raised, the barrier gate could not be raised, and unless the gate has been raised, the dock leveler could not be operated.

Figure 5:
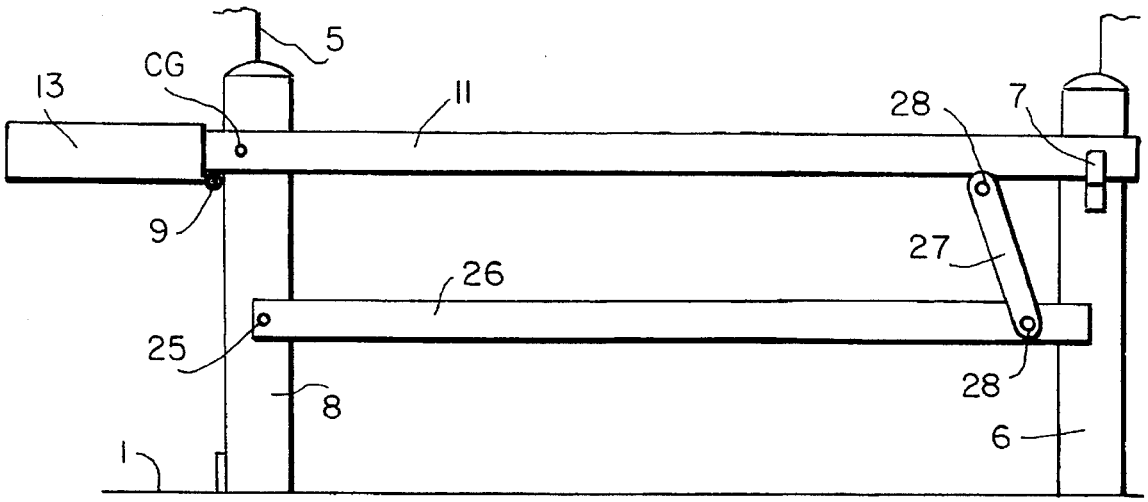
Figure 6:
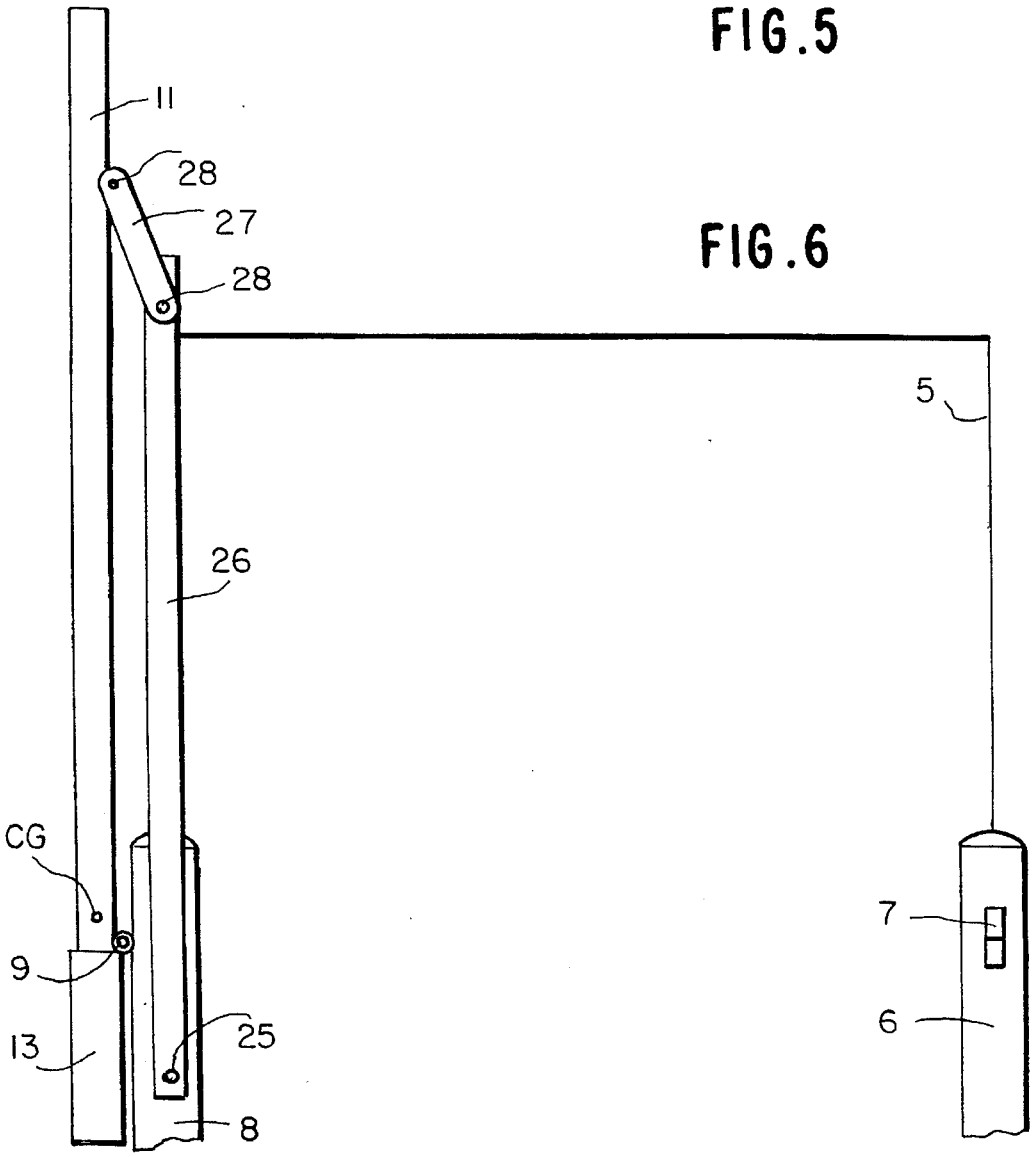

Referring now to FIGS. 5 and 6 a third preferred embodiment of this invention is depicted. In the embodiment of FIGS. 5 and 6 the same numerals as used in the first embodiment are carried forward. FIGS. 5 and 6 illustrate an embodiment employing a secondary barrier 26. Such is attached to the primary barrier 11 to prevent a low cart from slipping under the bar. In order to accomplish this result, a bar 26 is mounted on the support 8 by means of a pin 25. This pin 25 provides the pivot point for the bar 26. The other end of the bar is supported by a link 27 which is attached by two pins 28. Thus, the bar 26 moves with the barrier 11 as illustrated in FIG. 6. In the raised position there is no obstruction with the door opening because the pivot point is located on the barrier 8. While not illustrated, it will be understood that the embodiment of FIGS. 5 and 6 could be powered in a manner illustrated in FIG. 4.

Figure 7:
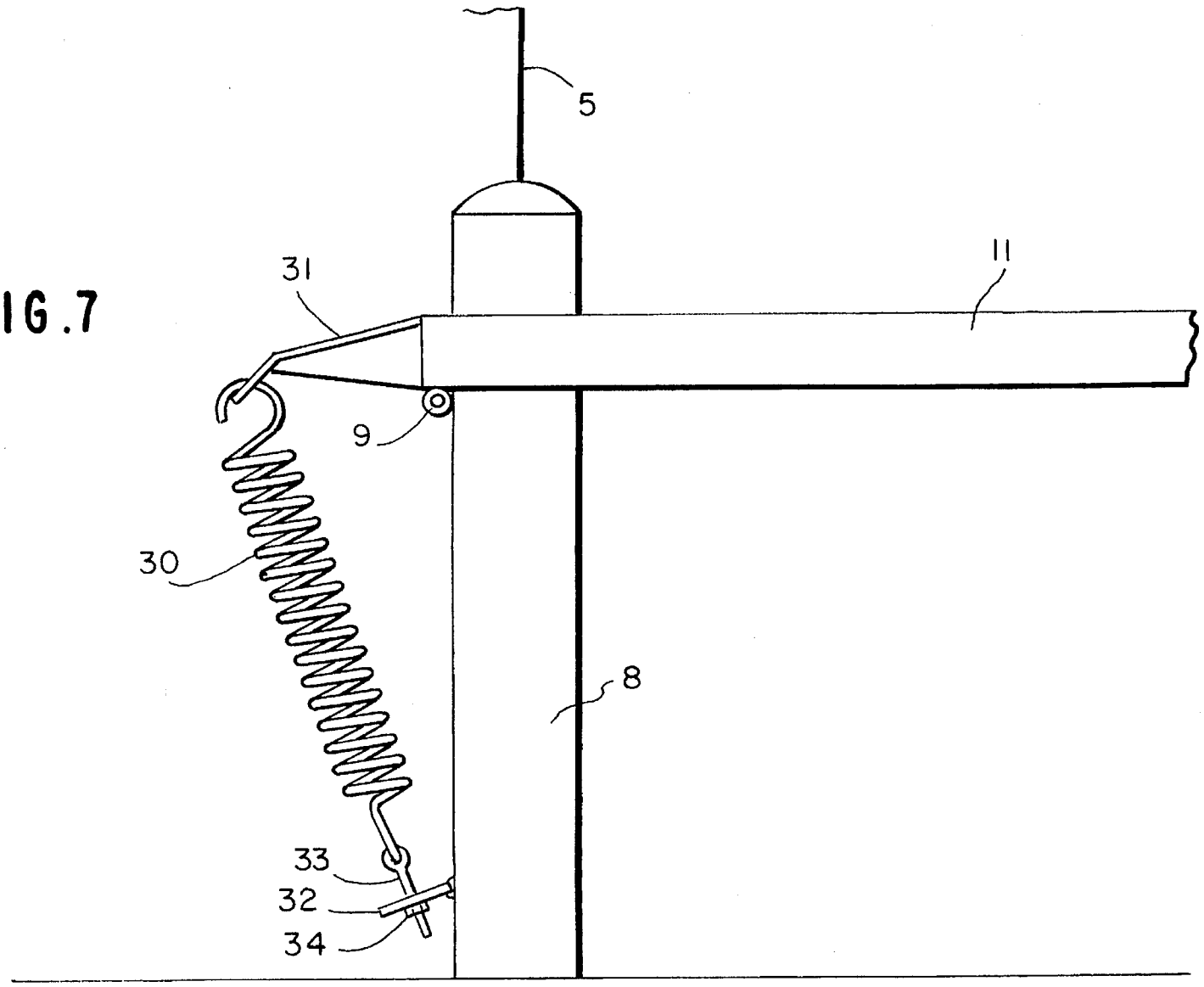
FIG. 7 is a view of a fourth preferred embodiment of this invention illustrating a spring mechanism to counterbalance the barrier gate.

Referring now to FIG. 7, a fourth embodiment is depicted. Those items which are identical to the embodiment of FIG. 1 are retained with the same identifying numerals. FIG. 7 illustrates using a spring mechanism rather than a counterweight to counterbalance the beam 11. A bracket 31 is attached to the beam 11, and a bracket 32 is attached to the post 8. A spring 30 has one end attached to the bracket 13 and the other end to an adjusting bolt 33 which passes through a hole in the bracket 32 and is secured by a nut 34 which can be adjusted to apply the desired tension to the spring 30. The position of the bracket 31, the stiffness of the spring 30 and adjustment of the tension of the spring are selected to provide the necessary counter force so that the barrier 10 can be easily raised or lowered. In addition, the mechanism causes the counter force to vary so that the barrier will remain raised when it is rotated to the vertical position, and will remain lowered when rotated to the horizontal position.

Other modifications of this invention can be practiced without departing from the essential scope thereof. For example, actuation could be linked to operation of the dockleveler.

I claim:

1. A barrier for a loading dock having an opening in a wall comprising:

a support placed on a side of said opening, a deformable barrier arm pivotedly connected to said support by a mounting for movement between a horizontal blocking position and a raised vertical position exposing said opening, said mounting having a pivotal connection to said support to permit said deformable barrier arm to move in a vertical arc for raising and lowering said arm and a translational connection to said barrier arm to permit relative motion between said barrier arm and said mounting upon the application of a horizontal load to said barrier arm without separating said mounting from said arm, and a second support placed on another side of said opening, and a bracket positioned on said second support to support said barrier arm.

2. The barrier arm of claim 1 further comprising means coupled to said barrier arm to bias said barrier arm toward either end of its motion whereby said barrier arm will remain at either said horizontal blocking position or said vertical position.

3. The barrier arm of claim 2 wherein said means coupled to said barrier arm comprises a spring positioned between said barrier arm and a fixed point whereby said spring is tensioned when said barrier arm is either raised or lowered to maintain said barrier arm in that position.

4. The barrier arm of claim 1 further comprising a counterweight positioned on said barrier arm to position a center of gravity of said barrier arm and counterweight to a position displaced from said pivotable connection whereby said barrier arm will remain at either said horizontal blocking position or said vertical position.

5. The barrier arm of claim 1 further comprising, an actuator to raise said deformable arm and a coupling between said actuator and said arm.

6. The barrier arm of claim 5 wherein said actuator comprises a linear actuator, said linear actuator having one end coupled to said arm and another end mounted to said coupling.

7. The barrier arm of claim 5 wherein said actuator comprises an hydraulic cylinder, said hydraulic cylinder having one end coupled to said arm and another end mounted to said coupling.

8. The barrier arm of claim 1 further comprising a secondary bar coupled to said deformable arm for vertical movement therewith.

9. A barrier for a loading dock having an opening in a wall comprising:

a dock leveler positioned in a floor of said loading dock adjacent said opening, said dock leveler having a horizontal position where traffic may cross to adjacent areas, a support placed on a side of said opening along side said dock leveler, a deformable barrier arm pivotedly connected to said support by a mounting for movement between a horizontal blocking position and a raised vertical position exposing said opening, said mounting having a pivotal connection to said support to permit said deformable barrier arm to move in a vertical arc for raising and lowering said arm and a translational connection to said barrier arm to permit relative shifting motion between said barrier arm and said mounting upon the application of a horizontal load to said barrier arm without separation from said mounting.

10. The barrier of claim 9 further comprising a second support placed on another side of said opening and an opposite side of said dock leveler, and a bracket positioned on said second support to support said barrier arm.

11. The barrier of claim 9 further comprising means coupled to said barrier arm to bias said barrier arm toward either end of its motion whereby said barrier arm will remain at either horizontal blocking position or said vertical stored position.

12. The barrier arm of claim 11 wherein said means coupled to said barrier arm comprises a counterweight positioned on said barrier arm to position a center of gravity of said barrier arm and counterweight to a position displaced from said pivotable connection whereby said barrier arm will remain at both a horizontal operative position and a vertical stored position.

13. The barrier arm of claim 11 wherein said means coupled to said barrier arm comprises a spring positioned between said barrier arm and a fixed point whereby said spring is tensioned when said barrier arm is either raised or lowered to maintain said barrier in that position.

14. The barrier arm of claim 11 wherein said mounting comprises first and second vertically spaced plates with said barrier arm therebetween, said pivotal connection coupled to one of said plates, said plates having thru-holes of a first diameter to accommodate compatible mounting pins, and said deformable barrier arm having thru-holes of a larger diameter to permit relative motion between said mounting and said deformable arm as said arm bends in response to an applied load.

15. The barrier arm of claim 9 further comprising, an actuator to raise said deformable arm and a coupling between said actuator and said arm.

16. The barrier arm of claim 15 wherein said actuator comprises a linear actuator, said linear actuator having one end coupled to said arm and another end mounted to said coupling.

17. The barrier arm of claim 15 wherein said actuator comprises an hydraulic actuator, said hydraulic actuator having one end coupled to said arm and another end mounted to said coupling.

18. The barrier arm of claim 9 further comprising a secondary bar coupled to said deformable arm for vertical movement therewith.

19. The barrier arm of claim 18 further comprising a pivotable mount on said support for one end of said secondary bar and a link coupling the other end of said secondary bar to said deformable arm.

20. The barrier arm of claim 18 further comprising a second support positioned on another side of said opening and said dock leveler, said deformable arm and said secondary bar bearing on said second support when a horizontal load is applied to both said deformable arm and said secondary bar.

21. A barrier for a loading dock having an opening in a wall comprising:

a support placed on a side of said opening, a deformable barrier arm pivotedly connected to said support by a mounting for movement between a horizontal blocking position and a raised vertical position exposing said opening, said mounting having a pivotal connection to said support to permit said deformable barrier arm to move in a vertical arc for raising and lowering said arm and a translational connection to said barrier arm to permit relative motion between said barrier arm and said mounting upon the application of a horizontal load to said barrier arm without separating said mounting from said arm, wherein said mounting comprises first and second vertically spaced plates with said barrier arm therebetween, said pivotal connection coupled to one of said plates, said plates having thru-holes of a first diameter to accommodate compatible mounting pins, and said deformable barrier arm having thru-holes of a larger diameter to permit relative motion between said mounting and said deformable arm as said arm bends in response to an applied load.

22. A barrier for a loading dock having an opening in a wall comprising:

a support placed on a side of said opening, a deformable barrier arm pivotedly connected to said support by a mounting for movement between a horizontal blocking position and a raised vertical position exposing said opening, said mounting having a pivotal connection to said support to permit said deformable barrier arm to move in a vertical arc for raising and lowering said arm and a translational connection to said barrier arm to permit relative motion between said barrier arm and said mounting upon the application of a horizontal load to said barrier arm without separating said mounting from said arm, and a secondary bar coupled to said deformable arm for vertical movement therewith.

23. The barrier arm of claim 22 further comprising a pivotable mount on said support for one end of said secondary bar and a link coupling the other end of said secondary bar to said deformable arm.

24. The barrier arm of claim 22 further comprising a second support positioned on another side of said opening, said deformable arm and said secondary bar bearing on said second support when a horizontal load is applied to both said deformable arm and said secondary bar.

* * * * *